United States Patent [19]

Przytarski

[11] 4,373,643

[45] Feb. 15, 1983

[54] TRANSPORT CONTAINER

[75] Inventor: Joachim Przytarski, Berlin, Fed. Rep. of Germany

[73] Assignee: KTS, Kunstoff-Technische Spezialfertigungen Anni Przytarski, Berlin, Fed. Rep. of Germany

[21] Appl. No.: 288,348

[22] Filed: Jul. 30, 1981

[30] Foreign Application Priority Data

Apr. 3, 1981 [DE] Fed. Rep. of Germany ..... 3114174

[51] Int. Cl.[3] ..... B65D 25/14; B65D 90/04; B65D 90/06

[52] U.S. Cl. ..... 220/450; 206/454; 217/3 R; 217/5; 220/468

[58] Field of Search ..... 220/468, 469, 327, 445, 220/450, 465, 460, 420, 425, 467, 452, 902, 901, 1.5; 217/128, 131, 3 R, 5; 206/454, 485, 811, 575, 524.1, 1, 524.2, 524.3, 524.9, 524.6

[56] References Cited

U.S. PATENT DOCUMENTS

| | | | |
|---|---|---|---|
| 1,904,400 | 4/1933 | Bangs et al. | 220/452 |
| 1,964,795 | 7/1934 | Frary | 220/445 |
| 2,066,337 | 1/1937 | Cunningham | 217/5 |
| 2,251,281 | 8/1941 | Howie | 220/452 |
| 2,485,646 | 10/1949 | Norquist | 217/131 |
| 3,009,600 | 11/1961 | Matsch | 220/450 |

*Primary Examiner*—Allan N. Shoap
*Assistant Examiner*—Robert Petrik
*Attorney, Agent, or Firm*—Allison C. Collard; Thomas M. Galgano

[57] ABSTRACT

A transport container which is suitable, in particular, for transport on airplanes, should be lightweight and, in addition, assure an absolute safe insulation of the interior of the container against severe climatic changes. This is particularly important when transporting art articles which otherwise could be damaged. In accordance with the invention, such a transport container is so structured that the walls and the lid consist of a plurality of layer zones which are coordinated with each other with respect to their efficiency characteristics—namely, an inner layer zone consisting of a rigid moisture-storing material, a heat-insulating material layer mounted atop the inner layer zone and covered on both sides with a water-impervious foil, a wide mesh-like grid structure which rests on the heat-insulating material layer and forms a plurality of air chambers and an outer wall of the transport container which covers the grid structure.

6 Claims, 2 Drawing Figures

TRANSPORT CONTAINER

Figure 1:
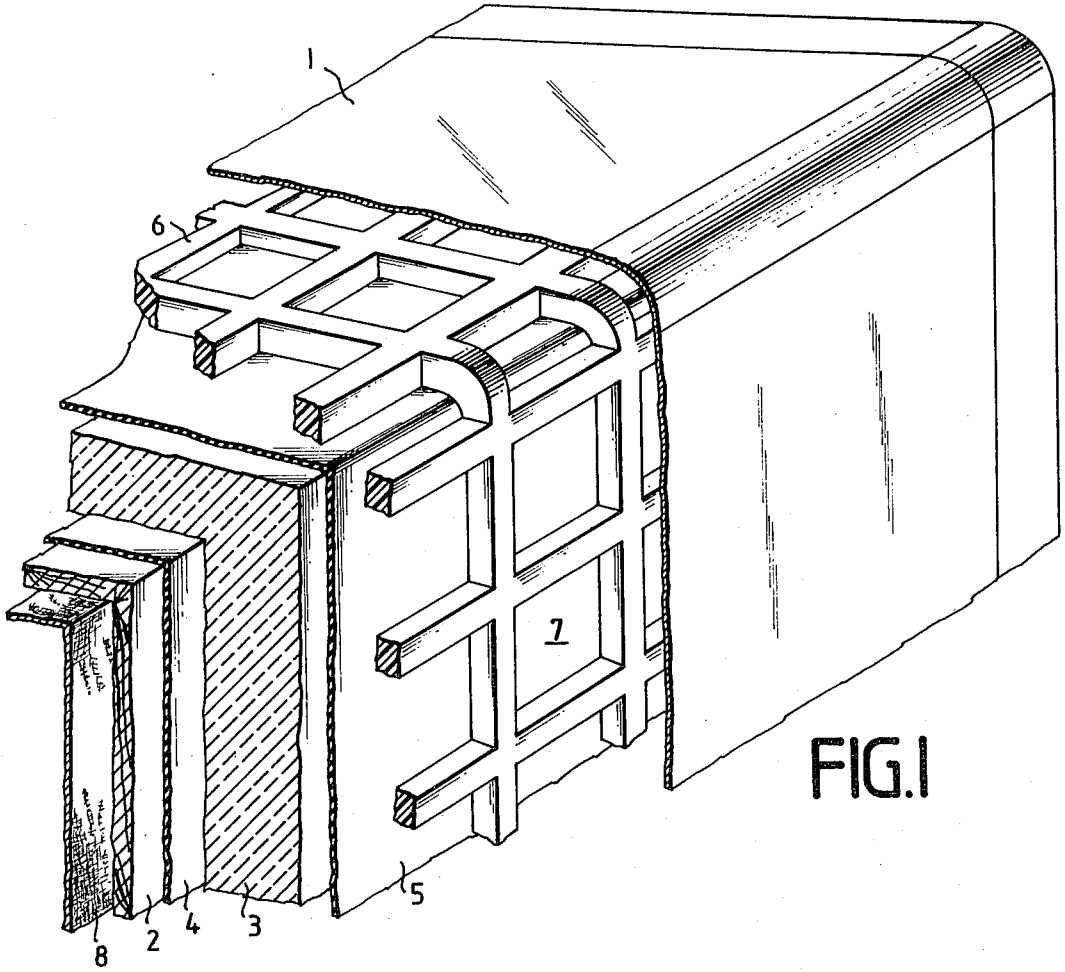

The invention relates to a lightweight transport container for transporting goods which are sensitive to humidity and temperature changes. Such transport containers are used, for example, for transporting art articles, especially if they are being transported over large distances with severe temperature and/or humidity fluctuations.

The transport of articles which consist of materials which are subject to swelling and are of different swelling characteristics or different swelling directions, and which therefore assume a different volume due to the effect of humidity fluctuations, is always problematic when these humidity changes occur so rapidly that cracks occur within the material structure within the connecting material of different parts (e.g., the glue of picture frames). Since there is a strong dependency of the swelling degree on the changing speed of the entropy, i.e., the temperature and humidity, it is an object of the invention to insulate the goods to be transported against these ambient influences, such that these influences may occur only with a great time delay, since they cannot be completely eliminated.

The same negative consequences of the formation of cracks or even the destruction of the material is observed with the kinetic occurrence of drying out. This occurs when the goods to be transported are moved through very hot and dry zones for a longer period of time.

During the construction of hitherto known containers, these interrelations were clearly not taken into consideration. These transport containers were primarily so constructed that the articles transported therein were mainly protected from mechanical damage due to shocks. The interiorly-disposed insulation layers made of organic and inorganic materials improves the protection from mechanical damage and also gradually reinforces the heat throughput resistance, but they are not suitable for protecting the interior of the transport container from unbearable, rapidly-changing temperature and/or humidity fluctuations. A further disadvantage of the known transport containers is that the used insulating materials supply moisture in an uncontrollable manner, especially to works of art, due to the saturation degree of such materials or, on the other hand, they even remove moisture therefrom. Furthermore, known transport containers are not vapor proof, so that the moisture is spontaneously removed from the container in a substantially moisture-free environment (e.g., in an airplane at high altitudes), thus causing crack formations, distortions and ungluing. This is because the adjustment of the outer temperature to the material within the containers occurs in a relatively short time, so that one can observe damage of the art work to be transported due to xpanding or shrinking tensions.

It is therefore an object of the invention to provide a transport container which has a substantially constant interior climate—namely, the climate of the article inserted, and the entropy of which (temperature, humidity and pressure) is such that even when the transport container is subjected to rapid extreme outer climatic changes, there is such a large delay that changing climatic influences on the transported goods is eliminated.

This object of the invention is objected in that the walls and lids are composed of a plurality of layer zones which are coordinated with each other with respect to their operating characteristics—namely, an inner layer zone consisting of a rigid, moisture-storing material, a heat insulating layer which covers the inner layer and is, in turn, covered on both sides thereof with a water impervious foil, a wide mesh-like grid structure which rests on the heat-insulating layer and forms a plurality of air, and an outer wall of the transport container which covers the grid structure.

Due to this composition and structure of the inventive transport container, the goal to be achieved is obtained. The structure and the sequence of the layer zones of the inventive transport container assure a substantial constancy of the inner climate of the transport container. This is particularly attributed to the inner layer zone which, in a further embodiment of the invention, consists of a rigid wood, in particular beechwood, which, in a natural manner, stores moisture which may be given off by the work of art and releases the moisture, if so desired. Above all, the storage zone assumes the climatic condition of the environment of the work of art before inserting the article to be transported (i.e., the work of art). For this purpose, the opened inventive transport container is placed in the storage room of the work of art to be transported therein for at least 24 hours before the work of art is inserted therein. In this manner, the work of art is exposed to the same climate as it was stored in before, after the transport container is closed, i.e., in a climatic environment, e.g., in an air-conditioned museum. Therefore, the optimum storage climate is assumed by the transport container.

Therefore, the inner zone of the wall which is closest to the articles to be transported acts as a natural humidity regulator. This zone is effectively protected against any further humidity transmission by covering it with a water impervious foil which consists of a hydrophobic material. In a further embodiment of the invention, these foils have reflective surfaces. It had been shown that, by the provision of reflective surfaces, the temperature constancy in the interior of the transport container can be maintained for a longer time period, in contrast to the situation when the surfaces are non-reflective.

The adjacent dry, heat insulation layer provides the desired temperature constancy for the inner space of the transport container, in particular with the adjacent outer grid structure which is covered by the outer sheath of the transport container and in which a plurality of air spaces are present. These air spaces constitute permanent air spaces and offer a very effective heat insulation, as experience has shown.

In a further embodiment of the invention, the inner layer zone which serves as the moisture regulating layer is made of wood. This is preferably covered on the side facing the inside of the transport container with a relatively thin layer of fine fibered textile material which permits moisture to penetrate but, on the other hand, provides a sufficient cushion to prevent scratches on the goods to be transported. In addition, the textile material layer prevents the formation of condensation water drops on the inner face of the layer zone consisting of wood when the transport container is improperly handled.

Other objects and features of the present invention will become apparent from the following detailed description when taken in connection with the accompanying drawings which disclose one embodiment of the invention. It is to be understood that the drawings are designed for the purpose of illustration only and are not intended as a definition of the limits of the invention.

Figure 2:
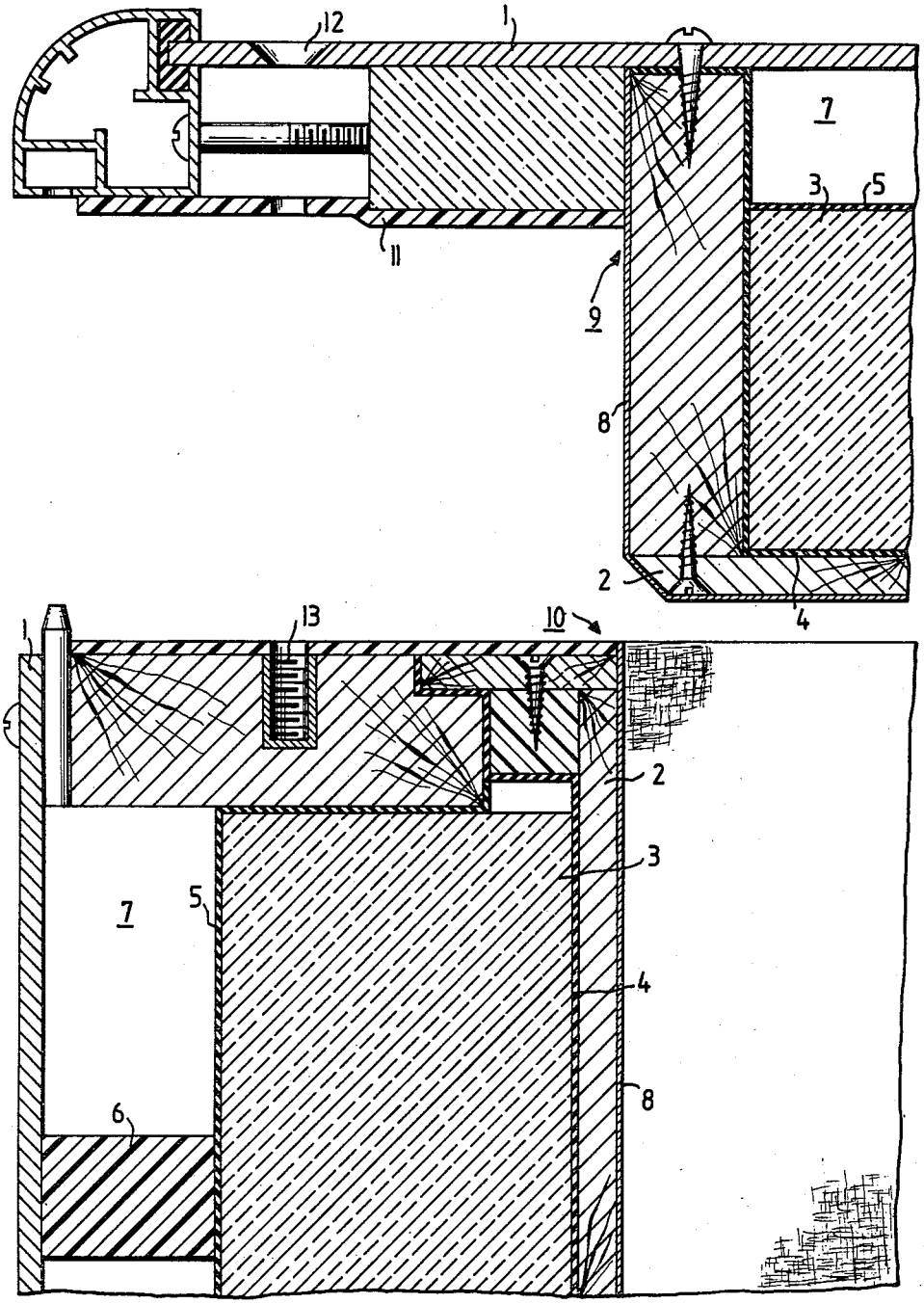

In the drawings, wherein similar reference characters denote similar elements throughout the several views:

FIG. 1 is a perspective view of the inventive transport container, with portions cut away to expose the individual layer zones; and FIG. 2 is a sectional view of the transport container in the lid area.

In accordance with the drawings, the outer wall 1 is composed of plates which advantageously consist of a highly reflective, light metal, so as to reduce the weight of the inventive transport container, on the one hand, and to keep the heat absorption to a minimum, on the other hand.

The inner layer zone 2 consists of a moisture-storing material, for example, beechwood, which is suitable for absorbing superfluous air moisture or humidity and which releases moisture when the relative humidity decreases in the inner space of the container, so that the relative humidity remains substantially constant. The inner face of inner layer zone 2 is preferably covered with a fine fibered textile material 8.

On top of this layer zone 2, a further layer zone 3 is mounted consisting of a heat-insulating material which is enclosed by two foils 4 and 5 which are water impermeable and serve as a water vapor barrier.

The wide mesh-like grid structure 6 is mounted on top of layer zone 3 forming a plurality of enclosed air chambers 7, since it is covered hermetically by the outer wall 1, thus eliminating any possibility of convection.

The outer wall 1 which is made of correspondingly rigid material protects the inventive transport container from the reaction of outer pressure forces in a sufficient manner.

FIG. 2 illustrates the connection of the lid to the container wall, wherein the lid 9 is shown shortly before being mounted onto container wall 10. One can see that the edge 11 of container 9 corresponds to the width of container wall 10, while the lid portion corresponds in its composition exactly to the composition of the container wall 10, so that the same favorable insulation values are extended to the lid and so that the constancy of the climatic relationship of the inner space of the transport container and the articles contained therein is assured.

After fully inserting lid 9 such that its edge 11 rests upon the upper side of the container wall 10 in sealing engagement therewith, the sealing connection is maintained by screws (not shown) which are inserted into through bores 12 in the lid and which engage thread bores 13.

Thus, while only one embodiment of the present invention has been shown and described, it will be obvious that many changes and modifications may be made thereunto, without departing from the spirit and scope of the invention.

What is claimed is:

1. A lightweight transport container for transporting goods which are sensitive to humidity and temperature changes, of the type composed of walls and at least one lid, the improvement comprising:

said walls and lid each being composed of a plurality of layer zones which are coordinated with each other with respect to their operating characteristics, including an inner layer zone comprising a rigid, moisture-storing material, a heat-insulating material layer zone disposed atop said inner layer zone which is covered on both its inner and outer sides with a water impermeable foil, a wide mesh-like grid structure which rests on the foil covering the outer side of said heat-insulating material layer zone and forms a plurality of air chambers, and an outer wall for said transport container which covers said grid structure.

2. The transport container according to claim 1, wherein said foil consists of water vapor-tight material having reflective surfaces.

3. The transport container according to claim 1 or 2, wherein said inner layer zone comprises wood, and wherein said inner layer zone has an inner face which limits the inner space of the container which is covered with a fine fibered textile material.

4. The transport container according to claim 3, wherein said wood is beechwood.

5. The transport container according to claim 1 or 2, wherein said outer wall comprises a thermal insulation material which is reinforced on both sides with a foil consisting of highly rigid and reflective material.

6. The transport container according to claim 1, wherein said lid has an edge which completely overlaps the container walls in a sealing manner and is mounted thereon with screws, said lid in said mounted state projecting into the inner chamber of the container defined by said walls.

* * * * *